US005403692A

United States Patent [19]

Yokokawa et al.

[11] Patent Number: 5,403,692

[45] Date of Patent: Apr. 4, 1995

[54] ELECTROPHOTOGRAPHIC PHOTORECEPTOR

[75] Inventors: Motoko Yokokawa; Masaharu Shirai; Yuichi Yashiki; Wataru Nakabayashi; Isamu Ishiko; Kazuaki Aoki, all of Minami-ashigara, Japan

[73] Assignee: Fuji Xerox Co., Ltd., Tokyo, Japan

[21] Appl. No.: 67,167

[22] Filed: May 26, 1993

Related U.S. Application Data

[63] Continuation of Ser. No. 781,596, Oct. 23, 1991, abandoned.

[30] Foreign Application Priority Data

Oct. 26, 1990 [JP] Japan ..... 2-287231

[51] Int. Cl.[6] ..... G03G 5/06

[52] U.S. Cl. ..... 430/135; 430/83

[58] Field of Search ..... 430/135, 94, 96, 95, 430/83

[56] References Cited

U.S. PATENT DOCUMENTS 4,072,518 2/1978 Leder ..... 430/85
4,381,338 4/1983 Suzuki ..... 430/135
4,434,219 2/1984 Sumino ..... 430/135

*Primary Examiner*—John Goodrow
*Attorney, Agent, or Firm*—Oliff & Berridge

[57] ABSTRACT

An electrophotographic photoreceptor having a high chargeability and a low dark decay is disclosed, which comprises an electrically conductive support having formed thereon a light-sensitive layer containing as a charge generating material a pigment which has been subjected to an acid washing treatment to lower the content of metal impurities below 500 ppm or less.

12 Claims, 2 Drawing Sheets

ELECTROPHOTOGRAPHIC PHOTORECEPTOR

This is a continuation of application Ser. No. 07/781,596, filed Oct. 23, 1991, now abandoned.

FIELD OF THE INVENTION

The present invention relates to an electrophotographic photoreceptor having an increased chargeability and a reduced dark decay by using an organic pigment washed with an acid as a charge generating material.

BACKGROUND OF THE INVENTION

Hitherto, as a charge generating material for an electrophotographic photoreceptor, various materials are known and organic pigments are also used. The characteristics of a charge generating material give a large influence on the characteristics of the electrophotographic photoreceptor. In the case of using an organic pigment as a charge generating material, the structure itself of the organic pigment largely influences on the characteristics of the photoreceptor.

It has been found by the inventors that metal impurities contained in the organic pigment also give influences on the characteristics of the photoreceptor. Such metal impurities sometimes enter an organic pigment during the production of the pigment. Examples of the metal impurity entering in the step of producing the organic pigment are metals from a reaction vessel when the vessel is made of stainless steel, iron, etc., from a container in which the pigment is ground, or from residues such as reaction reagents, a catalyst, etc., impurities formed by the corrosion of a metal vessel in the case of carrying out acid pasting in the metal vessel or impurities by the corrosion of the vessel by a halogen gas. As the metal impurities entering the organic pigment, iron is most and according to the entering route, iron oxides are also included. Other metal impurities entering an organic pigment are stainless steel components such as Cu, Ni, Cr, etc., transition metals such as Zn, Al, Mg, Ti, V, Co, W, etc., and an alkali metal such as K, Ca, Na, etc.

Many of these metals have an electric resistance lower than the electric resistance of pigments in the dark and in particular, when such a metal exists in the pigment in the form of metal oxides, metal sulfides, metal chlorides, etc., the electric resistance of the pigment is lowered so that the resulting photoreceptor tends to be undeveloped in portions. Also, if such metal impurities exist, the chargeability of the photoreceptor is frequently lowered wholly.

Furthermore, even when the light-sensitive layer is formed using the same charge generating material, the resulting photoreceptors sometimes exhibit different chargeabilities or dark decay, and hence there are problems that the photoreceptors having uniform electrophotographic characteristics are produced with difficulty, and those having a low chargeability and a high dark decay are often obtained.

SUMMARY OF THE INVENTION

The present invention has been made for solving the foregoing problems.

An object of this invention is, therefore, to provide electrophotographic photoreceptors having uniform electrophotographic characteristics, a high chargeability, and a low dark decay.

As the result of intensive studies, the inventors have discovered that the aforesaid problems are caused by the metal impurities contained in a charge generating material being used, and the present invention has been accomplished based on the discovery.

That is, the present invention is an electrophotographic photoreceptor comprising an electrically conductive support having formed thereon a light-sensitive layer containing as a charge generating material a pigment which has been subjected to an acid washing treatment to lower the content of metal impurities to 500 ppm or less.

DETAILED DESCRIPTION OF THE INVENTION

The electrophotographic photoreceptor of this invention is described in detail below.

FIG. 1 to FIG. 6 each is a schematic cross sectional view showing the layer structure of each of the electrophotographic photoreceptors of this invention.

Figure 1:
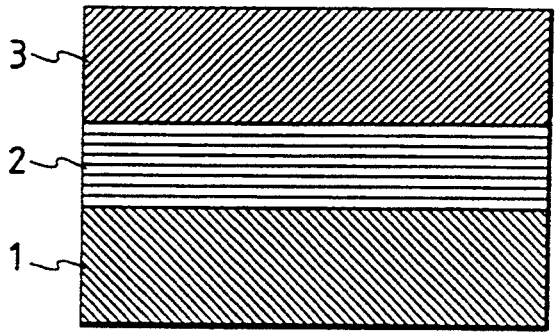
FIG. 1 to FIG. 6 each shows the schematic section view of each of the electrophotographic photoreceptors of this invention.
Figure 2:
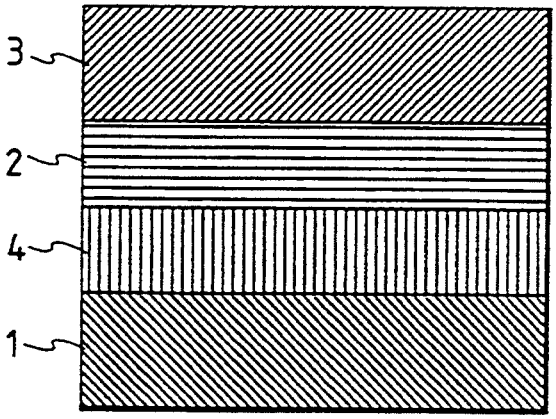
Figure 3:
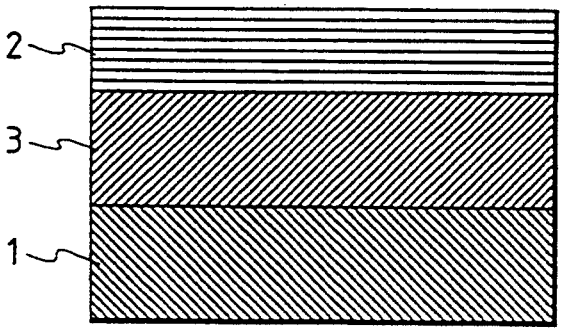
Figure 4:
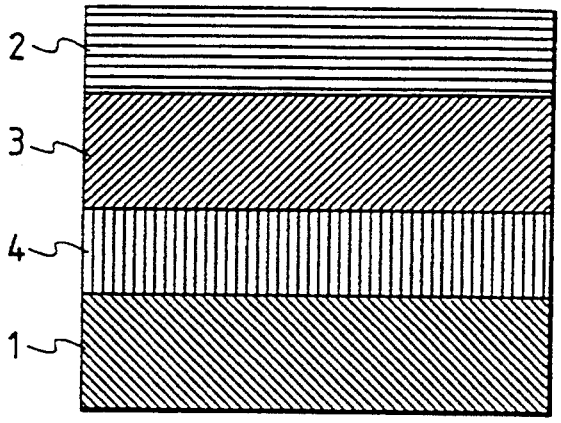

FIG. 1 to FIG. 4 each is an example that the light-sensitive layer is a laminated type layer. In FIG. 1, charge generating layer 2 is formed on electrically conductive support 1 and charge transport layer 3 is formed on the layer 2, and in FIG. 3, charge transport layer 3 is formed on conductive support 1 and charge generating layer 2 is formed on layer 3. In FIG. 2 and FIG. 4, subbing layer 4 is formed on conductive support 1.

Figure 5:
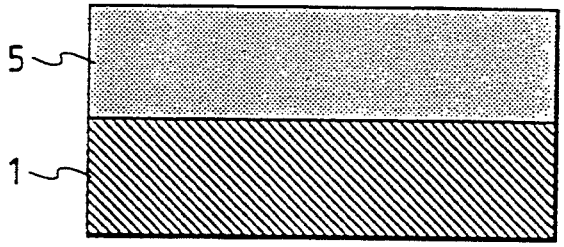
Figure 6:
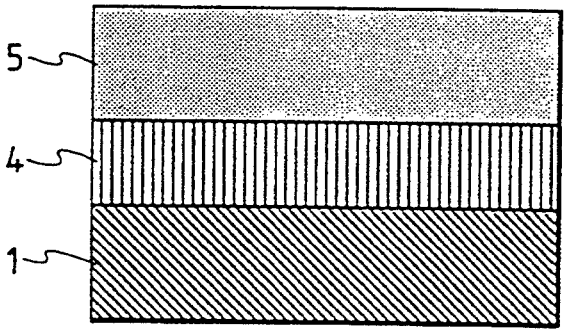

Also, FIG. 5 and FIG. 6 each is an example that the light-sensitive layer has a single-layer structure. In FIG. 5, photoconductive layer 5 is formed on electrically conductive support 1, and in FIG. 6, subbing layer 4 is formed on electrically conductive support 1.

In the electrophotographic photoreceptor of this invention, the foregoing charge generating layer or photoconductive layer contains a pigment as a charge generating material and in this case, it is necessary that the content of metal impurities in the pigment is lowered below 500 ppm (by weight) by an acid washing treatment.

The acid washing treatment can be carried out by dispersing a pigment in an acidic aqueous solution and stirring the dispersion.

As the acid being used for the acid aqueous solution, there are inorganic acids such as hydrochloric acid, sulfuric acid, nitric acid, phosphoric acid, etc., and organic acids such as trifluoroacetic acid, acetic acid, formic acid, acrylic acid, benzoic acid, etc.

The concentration of the acidic aqueous solution differs depending on the kind of the acid being used, but it is generally 20 wt % or less and preferably 10 wt % or less. In the case of using a strong acid having a dissociation constant of $1\times10^{-3}$ or more, such as hydrochloric acid, sulfuric acid, etc., an aqueous solution having an acid concentration of about 1 wt % is, as the case may be, sufficient but a better effect may be sometimes obtained using an aqueous acid solution having a concentration of about 40 wt %. However, in the case of a pigment prepared by an acid pasting treatment, since the pigment is treated with an acid solution having too high concentration, the pigment itself is dissolved to cause the change of the crystal form, the change of the grain diameters, etc., a care is required in the case of a strong acid such as sulfuric acid, etc. Also, in the case of using a weak acid having a dissociation constant of from $1\times10^{-7}$ to less than $1\times10^{-3}$ such as acetic acid, benzoic acid, etc., it is preferred to use an aqueous acid solution having a high concentration.

The above-described acidic aqueous solution may contain a chelate compound such as ethylenediaminetetraacetic acid amide, potassium cyanide, etc., generally in an amount of 10 wt % or less and preferably from 0.1 to 5 wt %.

The concentration of a pigment in the acidic aqueous solution is desirably high from the view point of separating an acid after the acid washing treatment. However, if the concentration of the pigment is too high, the pigment is not liable to be wetted with the acidic aqueous solution. Thus it is necessary to select a proper concentration of the pigment according to the properties of the pigment and the acidic aqueous solution. For example, in the case of using dibromoanthanthrone as the pigment, the proper concentration thereof is from about 5 wt % to 15 wt %.

The temperature of the acid washing treatment is selected in the range from room temperature to 100° C. but in general, the effect of removing metal impurities is larger as the temperature is higher and hence it is generally preferred to carry out the treatment at about 90° C. However, in this case, it is necessary to select the treatment temperature such that the pigment is not dissolved in the solution and/or the crystallinity of the pigment is not changed. The selection of the treatment temperature should also be done taking account of safety in handling of the acidic aqueous solution. In the case of dibromoanthanthrone, metal impurities can be most efficiently removed at the temperature of about 90° C. although the temperature may differ to some extent according to the kind of the acid being employed.

Also, the treatment time may be selected so that metal impurities can be efficiently removed.

Furthermore, if necessary, the treatment can be repeated for improving the washing efficiency.

Moreover, if necessary, before the acid washing treatment, the pigment may be wetted with an organic solvent such as methanol, ethanol, ketone, etc., or is dispersed in the organic solvent and washed with stirring, whereby as the case may be, the effect of the removal of metal impurities by acid washing is improved.

After the acid washing treatment, the pigment is separated by filtration or by treating with a centrifugal separator, etc., and washed with water. It is preferred that water washing is repeatedly carried out until the pH of washed water become 7. Also, it is desirable to use pure water for water washing.

In this invention, it is necessary that the content of metal impurities after being acid wash treated as described above is not more than 500 ppm (by weight). If the content of metal impurities is higher than 500 ppm, the effect of improving chargeability becomes insufficient.

In a practical example of the acid washing treatment of this invention, 1 part by weight of a pigment is disposed in 6 parts by weight of an aqueous solution of 6N hydrochloric acid and the dispersion is stirred for one hour at 90° C. Thereafter, the pigment is recovered by filtration, washed with water, and the washing operation is repeated until pH of the washed water becomes 7. Then, the pigment is dried at 100° C. until the water content becomes 0.1 wt % or less.

The inventors have also found that the particle sizes of a pigment give large influences not only onto the chargeability of the electrophotographic photoreceptor but also onto the light sensitivity thereof, and that by further subjecting the pigment which has been subjected to the acid washing treatment to a dry grinding treatment to control the particle sizes of the pigment, electrophotographic photoreceptors having a higher chargeability and a high sensitivity and giving images having a high image quality can be obtained.

The particle sizes of a pigment generally give large influences on the chargeability and the light sensitivity of electrophotographic photoreceptors as described above. In general, when the particle sizes of a pigment become large, the surface of the charge generating layer of the electrophotographic photoreceptor becomes rough, resulting in nonuniform contact at interface with another layer and in turn, reducing the image quality. On the other hand, when the particle size of a pigment is small, the percent transmission of the coated layer containing the pigment becomes high and hence the absorbance of the electrophotographic photoreceptor upon light exposure becomes high, whereby the charge generating efficiency becomes high and hence the light sensitivity becomes high. However, if the particle size of a pigment is too small, some pigments exhibit a reduced electric resistance, resulting in lowered chargeability. Therefore, it is desired to control the particle sizes of the pigment to proper sizes, and it is preferably 0.5 μm or less and more preferably 0.005 to 0.1 μm.

The particle sizes of a pigment largely differ depending on the synthesis condition of the pigment. By applying the acid washing treatment to the pigment as described above, the particle size of the pigment tends to be increased. Accordingly, it is preferred to apply a dry grinding treatment to the pigment after being subjected to the acid washing treatment, whereby the particle size of the pigment is controlled. By application of the dry grinding treatment, an electrophotographic photoreceptor having a high chargeability and a high sensitivity and being capable of forming images of a high image quality can be obtained.

The grinding treatment is carried out using a ball mixer, a sand mill, a kneader, a Banbury mixer, a dry attritor, a mortar (automatic), a vertical mill (super hybrid mill), a jet mill, a CF mill, a high cam mill, a disk mill, a pot mill, a paint shaker, etc. In particular, a ball mill is suitable and ball mill giving a large force, such as a planetary ball mill, a vibrating ball mill, etc., can be used with a good efficiency. In particular, a vibration mill gives a force of from 6 to 14 G and has an efficiency of from 10 to 100 times that of an ordinary mill.

The case of using a vibration ball mill is explained as an example. As the materials for the container and pot, alumina, nylon, silicon carbide, silicon nitride, tungsten carbide, zirconia, chromium steel, stainless steel, etc., can be used. Of these materials, alumina and zirconia are preferred since they are not easily abraded so that the amount of the metal component entered into the pigment is minimized.

The diameter of balls can be properly selected in the range of from 3 mm to 50 mm, depending on the grain size, hardness, etc., of the pigment. In general, if the diameter of balls is small, the particle size of the pigment thus attained is small but the initial grinding power is inferior, while if the diameter of balls is large, the initial grinding power is large but the particle size of the pigment attained is large. Also, in the case of a pigment having fine particle sizes, such as an organic pigment, it is necessary to prevent occurrence of a coating phenomenon. The term "coating phenomenon" is a phenomenon of attaching the ground raw material to the container and balls. If such a phenomenon occurs, a further grinding effect is not obtained, and thus occurrence of the coating phenomenon must be prevented.

For preventing occurrence of the coating phenomenon, the diameter of balls may be suitably selected. Empirically, when the diameter of balls become small, the coating phenomenon occurs frequently. Also, for preventing occurrence of the coating phenomenon, a small amount of a solvent such as cyclohexanone, methyl ethyl ketone, ethanol, ethylene glycol, triethylamine, ethyl silicate, methanol, etc., may be added to a pigment being ground in an amount of up to about 1 wt % to the pigment.

The packing amount of balls is preferably from about 40 to 90% by volume based on the volume of the container and the pigment may be added thereto in such an amount that the space between the balls is filed.

As the grinding time is longer, the particle size of the pigment becomes smaller. If the grinding time is too long, however, reaggregation of the pigment occurs as the case may be. Also the characteristics of the photoreceptor are not always good as the particle size of the pigment is small. The grinding time is preferably determined taking the above into consideration.

Also, in the case of using other ball mills such as a planetary ball mill, etc., grinding may be carried out by properly selecting materials of the container and the balls, the diameter of the ball, etc., as described above. In the case of a planetary ball mill, it is preferred to carry out grinding of a pigment in the state that $\frac{1}{3}$ of the volume of the container is filled with the balls, another $\frac{1}{3}$ with the pigment being ground, and the other $\frac{1}{3}$ is space.

The particle size of the pigment ground can be measured by various methods, for example, by observation with a scanning type electron microscope or a transmission type electron microscope, etc.; by measurement of a centrifugal sedimentation type particle size distribution; by observation of XRD intensity for measuring the primary particle sizes of the pigment upon grinding; by observation of the peak strength ratio of a specific peak of the XRD pattern to the ratio of the long axis to the short axis of the primary particle sizes; by measurement of the bulk density; by measurement of the specific surface areas, etc. In this invention, the average particle size of the ground pigment is measured using a transmission type electron microscope.

Pigment which are used as a charge generating material in this invention are generally classified into an organic pigment and an inorganic pigment.

Examples of the organic pigment include polycyclic quinone series pigments such as, e.g., dibromoanthanthrone, chlorinated anthanthrone, dibenzpyrenequinone, pyrenequinone, brominated dibenzpyrenequinone, pyranthrone, brominated pyranthrone, violanthrone, isoviolanthrone, dianthraquinone, benzanthroacridine, acridonecarbazole, dinaphthaloylacridone, anthraquinonethiazole, flavanthrone, and perylene pigments; phthalocyanine series pigments such as metal-free phthalocyanine, vanadium phthalocyanine, copper phthalocyanine, dichlorinated tin phthalocyanine, chlorinated gallium phthalocyanine, oxytitanium phthalocyanine, and chlorinated indium phthalocyanine; azo pigments such as monoazo pigments, disazo pigments, trisazo pigments, and more polyazo pigment; indigo pigments; bisbenzimidazole pigments; quinacridone pigments; pyrylium compounds; squalium compounds; cyanine compounds; quinocyanine compounds; trimethine compounds; and azulenium compounds.

As inorganic pigments, there are trigonal selenium, amorphous selenium, a Se-Te alloy, and a Se-As alloy.

The charge generating layer is constructed by dispersing in a binder resin a pigment which has been treated by an acidic aqueous solution or further subjected to a grinding treatment as described above.

The binder resin can be selected from various insulating resins. Organic photoconductive polymers such as poly-N-vinylcarbazole, polyvinylanthracene, polyvinylpyrene, etc. may also be used as the binder resin. Preferred are insulating resins such as polyvinyl butyral, polyarylate (a condensation product of bisphenol A and phthalic acid), a polycarbonate, a polyester, a phenoxy resin, a vinyl chloride-vinyl acetate copolymer, polyvinyl acetate, an acryl resin, polyacrylamide, polyamide, polyvinylpyridine, a cellulose series resin, a urethane resin, an epoxy resin, casein, polyvinyl alcohol, polyvinylpyrrolidone, etc.

The charge generating layer is formed by dispersing the foregoing pigment in a solution of the foregoing binder resin dissolved in an organic solvent and coating the resulting coating composition on a conductive support, a subbing layer formed on a conductive support, or a charge transport layer formed on the support. In this case, the mixing ratio (by weight) of the pigment to the binder resin is from 40/1 to $\frac{1}{4}$, and preferably from 20/1 to $\frac{1}{2}$. If the content of the pigment is too high, the stability of the coating composition is reduced, while if the content of the pigment is too low, the sensitivity is lowered.

The solvent used is preferably selected from those having a low solubility with respect to the subbing layer. Examples include alcohols such as methanol, ethanol, isopropanol, etc.; ketones such as acetone, methyl ethyl ketone, cyclohexanone, etc.; amides such as N,N-dimethylformamide, N,N-dimethylacetamide, etc.; dimethyl sulfoxides; ethers such as tetrahydrofuran, dioxane, ethylene glycol monomethyl ether, etc.; esters such as methyl acetate, ethyl acetate, etc.; aliphatic carbon halides such as chloroform, methylene chloride, dichlor-oethylene, carbon tetrachloride, trichloroethylene, etc.; and aromatic hydrocarbons such as benzene, toluene, xylene, ligroin, monochlorobenzene, dichlorobenzene, etc.

The coating composition can be coated by a conventional method such as a dip coating method, a spray coating method, a spinner coating method, a bead coating method, a Meyer bar coating method, a blade coating method, a roller coating method, a curtain coating method, etc.

Also, it is preferred to dry the coated layer by heating after setting to touch at room temperature. Drying by heating can be carried out at a temperature of from 80° to 200° C. for a range of from 5 minutes to 2 hours. The drying may be conducted with air blowing.

The thickness of the charge generating layer formed is usually from about 0.005 to 5 $\mu$m.

The charge transport layer is composed of a charge transport material and a binder resin. As the charge transport material, known materials can be used, but hydrazone series compounds, pyrazoline series compounds and the compounds represented by formula (I) can be advantageously used:

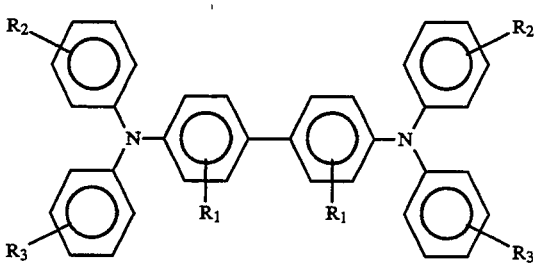

(I)

wherein $R_1$ and $R_2$ each represents a hydrogen atom or a methyl group and $R_3$ represents a hydrogen atom, a methyl group, or a halogen atom.

As the binder resin for the charge transport layer, the insulating resins as described above for the charge generating layer can be used.

The charge transport layer can be formed by preparing a coating composition of the foregoing components using an organic solvent being incapable of dissolving the charge generating layer and being selected from the organic solvents as described above and then coating the coating composition by the same manner as described above. The mixing ratio (by weight) of the charge transport material to the binder resin is usually in the range of from 5/1 to 1/5.

The thickness-of the charge transport layer usually from 5 μm to 50 μm.

When the light-sensitive layer has a single-layer structure as shown in FIG. 5 and FIG. 6, the light-sensitive layer is a photoconductive layer having the aforesaid charge generating material and charge transport material dispersed together in the aforesaid binder resin. In this case, the mixing ratio (by weight) of the charge transport material to the binder resin is preferably from 1/20 to 20/1 and the mixing ratio (by weight) of the charge generation material to the charge transport material is preferably from 1/20 to 1/1.

As the electrically conductive support, any materials which are conventionally used as a conductive support for electrophotographic photoreceptors can be used.

In this invention, a subbing layer may be formed on an electrically conductive support as shown in FIG. 2, FIG. 4, and FIG. 6. The subbing layer is effective for preventing injection of unnecessary electrostatic charges form the conductive support and has a function of increasing the chargeability of the light-sensitive layer. Furthermore, the subbing layer also has a function of increasing the adhesion between the light-sensitive layer and the conductive support.

The subbing layer may be made of polyvinyl alcohol, polyvinylpyrrolidone, polyvinylpyridine, cellulose ethers, cellulose esters, polyamides, polyurethanes, casein, gelatin, polyglutamic acid, starch, starch acetate, aminostarch, polyacrylic acid, polyacrylamide, or the like.

The thickness of the subbing layer is preferably from about 0.05 μm to 2 μm.

The invention is further explained in more detail with reference to the following Examples but the invention is not limited thereto. In the Examples and Comparative Examples, all parts and percents are by weight unless otherwise indicated.

EXAMPLE 1 AND COMPARATIVE EXAMPLE 1

To 2 parts of ethanol was added one part of dibromoanthanthrone (pigment) followed by stirring. Thereafter, the mixture was added to 6 parts of an aqueous solution of 6N hydrochloric acid and the resultant mixture was stirred for one hour at 90° C. Thereafter, the pigment was separated from the mixture by a centrifugal separation. Then, water was added to the pigment, followed by stirring lightly. Then, the pigment was separated by a centrifugal separation. After repeating the operation 5 times, pH of the washed water was almost 7. Thereafter, the pigment was dried overnight at 80° C. and further subjected to vacuum drying for 3 hours at 80°.

In a 0.25-liter agate container were placed 45 g of the pigment thus treated together with 12 agate balls having a diameter of 20 mm and the pigment was ground by a planetary ball mill (Fritsch P-5). In the grinding condition, the disk rotation number (revolution) was about 235 r.p.m., the pot rotation number (rotation) was about 50 r.p.m., and the grinding time was changed to 0 hour, 2 hours, 4 hours, and 8 hours to provide samples each having a different particle size. These characters are shown in Table 1 below as Examples 1-1, 1-2, 1-3, and 1-4.

Metal impurities in the pigments thus obtained were measured by inductivity coupled plasma mass spectrometry (ICP-MS) using a device ELAN ICP-MS manufactured by Perkin-Elmer Co. and these results are shown in Table 1. The content of metal impurities in the samples of these examples was reduced below 500 ppm.

When the particle sizes of the pigments obtained as described above were observed by a transmission type electron microscope and each average particle size was determined, it was confirmed that when the acid washing was applied, the average particle size of the pigment became large to some extent and when the grinding time was prolonged, the particle size become small.

Using each of dibromoanthanthrone subjected to the acid washing treatment described above and dibromoanthanthrone not subjected to the acid washing treatment for comparison (comparative Example 1), electrophotographic photoreceptors were prepared and they were evaluated.

That is, 10 parts of each of the pigments was mixed with 1 part of polyvinyl butyral (BM-1, trade name, made by Sekisui Chemical Co., Ltd.) and 100 parts of cyclohexanone. After dispersing the pigment by means of a paint shaker with glass beads for one hour, the mixture obtained was coated on an aluminum base plate with a Meyer bar and dried for 5 minutes at 100° C. to form a charge generating layer having a thickness of 0.5 μm.

Then, 1 part of N,N-diphenyl-N,N'-bis(8-methylphenyl)-[1,1'-biphenyl]-4,4'-diamine shown by formula (II) and 1 part of poly(4,4'-cyclohexylidenediphenylene carbonate) having the repeating unit shown by formula (III) and a molecular weight of 21,000 as charge transport materials were mixed with 8 parts of monochlorobenzene, and the mixture obtained was coated on the charge generating layer formed as described above by a Meyer bar, and dried for one hour at 120 C.° to form a charge transport layer of 20 μm in thickness.

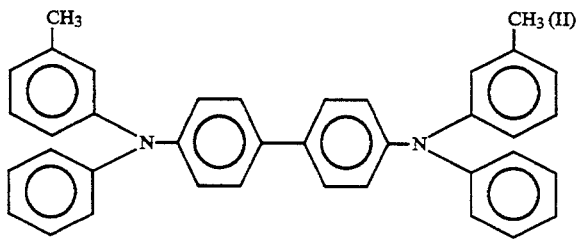

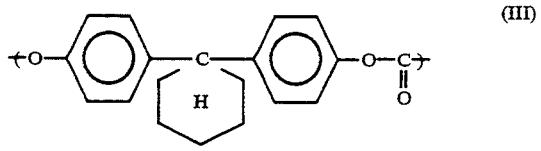

Each electrophotographic photoreceptor thus obtained was corona discharged at 40 μA using an electrostatic copying paper test apparatus (SP-428, trade name, made by Kawaguchi Denki K.K.), and after retaining the photoreceptor for 1 second in the dark, the photoreceptor was exposed at an illuminance of 5 lux, and then the electrophotographic characteristics were determined. Thus, the initial voltage $V_0$ (volt), the retentivity (dark decay ratio) after one second DD (%), and the half decay exposure amount $E_{\frac{1}{2}}$ (lux.second) were measured. The results obtained are shown in Table 1 below.

Also, for observing copied images, each photoreceptor was wound round on a drum and the copy images were obtained using a copying machine (FX 2700 modified machine, trade name, made by Fuji Xerox Co., Ltd.) with which the photoreceptor was mounted. The results obtained are shown in Table 1 below.

From the results shown in Table 1, it is seen that in the electrophotographic photoreceptors each prepared using the pigment subjected to the acid washing treatment, the chargeability was high and the dark decay ratio was low as compared to the electrophotographic photoreceptor prepared using the pigment which was not subjected to the acid washing treatment. Further as the grinding time was longer, the light sensitivity was increased and further good electrophotographic characteristics were obtained, but on the other hand, when the grinding time was 9 hours, the chargeability was lowered to some extent. Accordingly, it was confirmed that by controlling the grinding time to about 4 hours, the electrophotographic photoreceptor having a high chargeability and a high light-sensitivity could be obtained.

Furthermore, in the case of using the pigment subjected to the acid washing treatment, the image quality of the copy images was good and when the copying operation was carried out 10,000 times, the image quality was not changed.

EXAMPLE 2 AND COMPARATIVE EXAMPLE 2

To 6 parts of an aqueous solution of 12N sulfuric acid was added 1 part of metal-free phthalocyanine (pigment), followed by stirring for one hour at 90° C. Thereafter, the pigment was separated from the mixture by a centrifugal separation. Then, water was added to the pigment, followed by stirring lightly. The pigment was further separated by a centrifugal separation. After repeating the operation thrice, pH of the washed water was almost 7. Thereafter, the pigment was dried overnight at 80° C. and further subjected to vacuum drying for 3 hours at 80° C.

Then, 150 g of the pigment treated as described above was placed in a 0.7-liter alumina pot together with 1.1 kg of alumina balls having a diameter of 20 mm and was ground by a vibration ball mill (NB-0, trade name, made by Chuo Kakoki K.K.). In the grinding conditions, the vibration number was 1,000 cpm., the amplitude was 8 mm, and the grinding time was changed to 0 hour, 2 hours, 4 hours, and 8 hours to provide samples each having a different particle size. These characters are shown in Table 1 below as Examples 2-1, 2-2, 2-3, and 2-4.

Metal impurities in each pigment thus obtained were measured by ICP-MS and the results obtained are shown in Table 1. The content of metal impurities in the samples of these example was reduced below 500 ppm.

Also, the particle size of each pigment obtained as described above was observed by a transmission type electron microscope and the average particle size of each pigment was determined. By the results, it was confirmed that when the acid washing treatment was applied, the average particle size of the pigment became large to some extent and by prolonging the grinding time, the average particle size of the pigment become small to some extent.

Using each of metal-free phthalocyanine subjected to the acid washing treatment as described above and metal-free phthalocyanine not subjected to the acid washing treatment for comparison (Comparative Example 2), electrophotographic photoreceptors were prepared and their properties were evaluated. The results are shown in Table 1.

From the results shown in Table 1, it is seen that in the electrophotographic photoreceptors each obtained using the pigment subjected to the acid washing treatment, the chargeability was high and the dark decay ratio was low as compared to the electrophotographic photoreceptor obtained using the pigment which was not subjected to the acid washing treatment.

Each photoreceptor was wound on a drum and when the print images were obtained using a printer (modified machine for positive transfer development of XP-11, trade name, made by Fuji Xerox Co., Ltd.) with which the photoreceptor was mounted, the image quality was good. Furthermore, when the printing operation was carried out 10,000 times, the image quality was not changed.

Also, as the grinding time was longer, the light sensitivity was increased and further good characteristics were obtained, but on the other hand, in the case of grinding for 8 hours, the chargeability was lowered to some extent. Accordingly, it was confirmed that by controlling the grinding time to about 4 hours, the electrophotographic photoreceptor having a high chargeability and a high light sensitivity could be obtained.

EXAMPLE 3 AND COMPARATIVE EXAMPLE 3

To 6 parts of an aqueous solution of 1N hydrochloric acid was added 1 part of granular trigonal selenium (pigment), followed by stirring for 5 hours at 90° C. Thereafter, the pigment was separated from the mixture by a centrifugal separation. Then, water was added to the pigment, followed by stirring lightly. The pigment was separated by a centrifugal separation. After repeating the operation 5 times, pH of the washed water was almost 7. Thereafter, the pigment was dried overnight at 80° C. and further subjected to vacuum drying for 3 hours at 80° C.

When the content of metal impurities in each pigment thus obtained was measured by ICP-MS, the content of the metal impurities was 1140 ppm.

Then, when the acid washing treatment was further applied to the pigment by the same manner as above, it was seen that the content of the metal impurities was reduced to 330 ppm. The results obtained are shown in Table 1 below.

40 g of each pigment thus treated was placed in a 0.25-liter glass container together with 12 glass balls having a diameter of 20 mm and ground by means of a small-sized ball mill. In the grinding conditions, the rotation number of about 500 r.p.m. and the grinding time was changed to 0 hour, 2 hours, 4 hours, and 8 hours to provide samples each having a different particle size. These characteristics are shown in Table 1 as Examples 3-1, 3-2, 3-3, and 3-4.

Also, the particle sizes of each pigment obtained as described above were observed by a transmission type electron microscope as in Example 1 and the average particle size was determined. By the results, it was confirmed that when the acid washing treatment was applied, the average particle size became large to some extent and by prolonging the grinding time, the average particle size became small.

Using each of granular trigonal selenium subjected to the acid washing treatment as described above and, granular trigonal selenium not subjected to the acid washing treatment for comparison (Comparative Example 3), electrophotographic photoreceptors were prepared by the same manner as in Example 1 and they were evaluated. These results are shown in Table 1 below.

From the results shown in Table 1, it was confirmed that in the electrophotographic photoreceptors each obtained using the pigment subjected to the acid washing treatment, the chargeability was high and the dark decay ratio was low as compared to the electrophotographic photoreceptor obtained using the pigment which was not subjected to the acid washing treatment.

When each photoreceptor was wound on a drum and the copy images were obtained using a copying machine (FX 2700, trade name, made by Fuji Xerox Co., Ltd.) with which the photoreceptor was mounted, the image quality was good. Furthermore, when the copying operation was carried out 10,000 times, the image quality was not changed.

Also, as the grinding time was long, the light sensitivity was increased and further good characteristics were obtained, but on the other hand, when the grinding time was 8 hours, the chargeability was lowered to some extent. Accordingly, it was confirmed that by controlling the grinding time to about 4 hours, the electrophotographic photoreceptor having a high chargeability and a high light sensitivity could be obtained.

TABLE 1

| No. | Pigment | Treated No. of Acid Washing Treatment | Dry Grinding Time (hr) | Particle Size (μm) |
|---|---|---|---|---|
| Comp. Ex. 1 | Dibromoanthranthrone | None | None | 0.37 |
| Ex. 1-1 | Dibromoanthranthrone | Treated once | None | 0.52 |
| Ex. 1-2 | Dibromoanthranthrone | Treated once | 2 hrs. | 0.38 |
| Ex. 1-3 | Dibromoanthranthrone | Treated once | 4 hrs. | 0.22 |
| Ex. 1-4 | Dibromoanthranthrone | Treated once | 8 hrs. | 0.13 |
| Comp. Ex. 2 | Metal-Free Phthalocyanine | None | None | 0.42 |
| Ex. 2-1 | Metal-Free Phthalocyanine | Treated once | None | 0.42 |
| Ex. 2-2 | Metal-Free Phthalocyanine | Treated once | 2 hrs. | 0. 31 |
| Ex. 2-3 | Metal-Free Phthalocyanine | Treated once | 4 hrs. | 0.22 |
| Ex. 2-4 | Metal-Free Phthalocyanine | Treated once | 8 hrs. | 0.18 |
| Comp. Ex. 3 | Granular Trigonal Selenium | None | None | 0.44 |
| Ex. 3-1 | Granular Trigonal Selenium | Treated twice | None | 0.71 |
| Ex. 3-2 | Granular Trigonal Selenium | Treated twice | 2 hrs. | 0.44 |
| Ex. 3-3 | Granular Trigonal Selenium | Treated twice | 4 hrs. | 0.27 |
| Ex. 3-4 | Granular Trigonal Selenium | Treated twice | 8 hrs. | 0.22 |

| No. | Metal Impurities (ppm) | | | | | | | | | | | |
|---|---|---|---|---|---|---|---|---|---|---|---|---|
| | Fe | Cr | Ni | Zn | Al | Mg | Cu | K | Ca | Na | Si | Sum |
| Comp. Ex. 1 | 700 | 10 | 5 | 10 | 40 | 20 | 60 | 50 | 200 | 100 | 40 | 1255 |
| Ex. 1-1 | 100 | 15 | 5 | 2 | 10 | 10 | 30 | 10 | 20 | 20 | 10 | 222 |
| Ex. 1-2 | 100 | 15 | 5 | 2 | 10 | 10 | 30 | 10 | .20 | 20 | 10 | 222 |
| Ex. 1-3 | 100 | 15 | 5 | 2 | 10 | 10 | 30 | 10 | 20 | 20 | 10 | 222 |
| Ex. 1-4 | 100 | 15 | 5 | 2 | 10 | 10 | 30 | 10 | 20 | 20 | 10 | 222 |
| Comp. Ex. 2 | 600 | 50 | 10 | 10 | 30 | 10 | 50 | 100 | 200 | 100 | 50 | 1210 |
| Ex. 2-1 | 100 | 10 | — | — | — | — | — | 10 | 10 | 10 | 10 | 50 |
| Ex. 2-2 | 100 | 10 | — | — | — | — | — | 10 | 10 | 10 | 10 | 50 |
| Ex. 2-3 | 100 | 10 | — | — | — | — | — | 10 | 10 | 10 | 10 | 50 |
| Ex. 2-4 | 100 | 10 | — | — | — | — | — | 10 | 10 | 10 | 10 | 50 |
| Comp. Ex. 3 | 900 | 100 | 50 | 50 | 40 | 30 | 60 | 150 | 250 | 150 | 100 | 1880 |
| Ex. 3-1 | 200 | 30 | 20 | 10 | 10 | 10 | 10 | 10 | 10 | 10 | 10 | 330 |
| Ex. 3-2 | 200 | 30 | 20 | 10 | 10 | 10 | 10 | 10 | 10 | 10 | 10 | 330 |
| Ex. 3-3 | 200 | 30 | 20 | 10 | 10 | 10 | 10 | 10 | 10 | 10 | 10 | 330 |
| Ex. 3-4 | 200 | 30 | 20 | 10 | 10 | 10 | 10 | 10 | 10 | 10 | 10 | 330 |

| No. | Chargeability $V_0$ (V) | Dark Decay Ratio DD (%) | Half Decay Light Exposure Amount $E_{\frac{1}{2}}$ (lux · sec) | Initial Image Quality | Image Quality After Copying 10,000 Times |
|---|---|---|---|---|---|
| Comp. Ex. 1 | 400 | 75 | 4.5 | Image Density lowered | good |
| Ex. 1-1 | 600 | 95 | 4.6 | good | good |
| Ex. 1-2 | 600 | 90 | 4.0 | good | good |

TABLE 1-continued

| | | | | | |
|---|---|---|---|---|---|
| Ex. 1-3 | 600 | 92 | 3.8 | good | good |
| Ex. 1-4 | 550 | 88 | 3.5 | good | good |
| Comp. Ex. 2 | 300 | 78 | 5.5 | good | Density lowered |
| Ex. 2-1 | 500 | 93 | 5.6 | good | good |
| Ex. 2-2 | 505 | 92 | 5.2 | good | good |
| Ex. 2-3 | 490 | 94 | 5.0 | good | good |
| Ex. 2-4 | 450 | 85 | 4.0 | good | good |
| Comp. Ex. 3 | 100 | 50 | 3.6 | Image Density lowered | Image Density lowered |
| Ex. 3-1 | 900 | 95 | 3.8 | good | good |
| Ex. 3-2 | 905 | 95 | 3.5 | good | good |
| Ex. 3-3 | 880 | 90 | 3.4 | good | good |
| Ex. 3-4 | 850 | 85 | 3.4 | good | good |

As described above, since the light-sensitive layer contains as a charge generating material a pigment wherein the content of metal impurities is lowered below 500 ppm by an acid washing treatment, the electrophotographic photoreceptors of this invention have uniform electrophotographic characteristics, a high chargeability and a low dark decay ratio, and even when the electrophotographic photoreceptor is repeatedly used many times, it can give images having a good image quality.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive support having formed thereon a light-sensitive layer containing as a charge generating material a pigment which has been subjected to an acid washing treatment to lower the content of metal impurities to 500 ppm or less.

2. An electrophotographic photoreceptor comprising an electrically conductive support having formed thereon a light-sensitive layer containing as a charge generating material a pigment which has been subjected to an acid washing treatment to lower the content of metal impurities to 500 ppm or less, wherein the pigment which has been subjected to the acid washing treatment, is further subjected to a dry grinding treatment.

3. The electrophotographic photoreceptor as in claim 1, wherein the pigment is dibromoanthanthrone.

4. The electrophotographic photoreceptor of claim 1, wherein the pigment is an organic pigment.

5. The electrophotographic photoreceptor as in claim 2, wherein said pigment has a particle size of 0.5 μm or less.

6. The electrophotographic photoreceptor of claim 2, wherein said pigment is subjected to said dry grinding treatment for about 4 hours.

7. The electrophotographic photoreceptor of claim 1, wherein said acid has a concentration of 20 wt. % or less.

8. The electrophotographic photoreceptor of claim 1, wherein said acid has a concentration of about 40%.

9. The electrophotographic photoreceptor of claim 1, wherein said acid washing treatment is carried out at a temperature range of from room temperature to 100° C.

10. The electrophotographic photoreceptor of claim 1, wherein said pigment is wetted with an organic solvent before subjecting said pigment to the acid washing treatment.

11. The electrophotographic photoreceptor of claim 8, wherein said organic solvent is selected from the group consisting of methanol, ethanol and ketone.

12. The electrophotographic photoreceptor of claim 3, wherein said dibromoanthanthrone is present in an amount from about 5 wt. % to 15 wt. %.

* * * * *